US005401328A

United States Patent [19]

Schmitz, deceased

[11] Patent Number: 5,401,328

[45] Date of Patent: Mar. 28, 1995

[54] ARRANGEMENT FOR CLEANING MECHANICAL DEVICES, SMALL PARTS AND/OR ELECTRONIC SWITCHING UNITS

[75] Inventor: Rudolf Schmitz, deceased, late of St. Augustin, Germany, by Thea Schmitz, executor

[73] Assignee: Henkel Kommanditgesellschaft auf Aktien, Duesseldorf, Germany

[21] Appl. No.: 190,722

[22] Filed: Feb. 2, 1994

Related U.S. Application Data

[63] Continuation of Ser. No. 867,664, Jul. 2, 1992, abandoned.

[30] Foreign Application Priority Data

Jan. 3, 1990 [DE] Germany ..... 9000018 U

[51] Int. Cl.[6] ..... B08B 3/02

[52] U.S. Cl. ..... 134/58 R; 55/525; 55/DIG. 31; 134/95.2; 134/95.3; 134/103.2; 134/111; 134/153; 134/200; 210/499

[58] Field of Search ..... 134/58 R, 95.2, 95.3, 134/103.2, 111, 153, 200; 210/494.1, 499; 55/525, DIG. 31

[56] References Cited

U.S. PATENT DOCUMENTS

| | | | |
|---|---|---|---|
| 2,619,188 | 11/1952 | Haw et al. | 55/525 X |
| 2,698,628 | 1/1955 | Zademach et al. | 134/153 X |
| 2,764,171 | 9/1956 | Nolte | 134/153 X |
| 3,624,750 | 11/1971 | Peterson | 134/103.2 X |
| 3,780,872 | 12/1973 | Pall | 55/525 X |
| 4,025,363 | 5/1977 | De Santis | 134/200 X |
| 4,126,560 | 11/1978 | Marcus et al. | 55/525 X |
| 4,132,567 | 1/1979 | Blackwood | 134/153 X |
| 4,699,637 | 10/1987 | Iniotakis et al. | 55/525 X |
| 4,941,490 | 7/1990 | Gross | 134/95.3 |
| 5,107,876 | 4/1992 | Ozyjiwsky | 134/200 X |

FOREIGN PATENT DOCUMENTS

| | | |
|---|---|---|
| 8802667 | 4/1988 | European Pat. Off. . |
| 1962757 | 6/1967 | Germany . |
| 3802486 | 8/1988 | Germany . |

*Primary Examiner*—Philip R. Coe

*Attorney, Agent, or Firm*—Ernest G. Szoke; Wayne C. Jaeschke; Kenneth Watov

[57] ABSTRACT

A device for cleaning mechanical appliances, small parts and/or electronic switch units using cleaning liquids comprises a cleaning chamber ventilated by means of a fan. A baffle plate is arranged in front of an intake opening of the chamber. A door provides access to the chamber. A discharge chamber below the cleaning chamber collects the cleaning liquid for regeneration. The cleaning chamber is mounted above a square, closed substructure. The delivery connection piece of the fan is connected by a pipeline to the base region of the substructure. A ventilation pipeline leading both into the cleaning chamber and an evacuation pipeline opens into the upper region of the substructure. A rotary table in the cleaning chamber holds the objects to be cleaned. The cleaning chamber has at least one rising pipe which is supplied with cleaning liquid by a pump and which has spray nozzles directed toward the rotary table.

11 Claims, 2 Drawing Sheets

ARRANGEMENT FOR CLEANING MECHANICAL DEVICES, SMALL PARTS AND/OR ELECTRONIC SWITCHING UNITS

This application is a continuation of application Ser. No. 07/867,664, filed on Jul. 2, 1992, now abandoned.

BACKGROUND

1. Field of the Invention

This invention relates generally to cleaning apparatus, and more particularly to self contained apparatus for using cleaning fluids to automatically clean small parts or devices.

2. Discussion of Related Art

It is known that machine parts can be cleaned using containers, in which the machine parts to be cleaned are lowered into a washing liquid. In DE-GM 1 962 757, washing liquid is taken from a reservoir by means of a pump, sprayed onto the parts to be cleaned and then, after collection at an outlet, returned to the reservoir via filters. In the first of these cleaning systems, the cleaning effect is obtained solely by partial dissolution and softening and is therefore inadequate for many applications. Also, the liquid is difficult to regenerate. In addition, because the washing compartment is substantially filled with the cleaning liquid, the arrangement is undesirably heavy. Although the arrangement according to DE-GM 1 962 757 has moderate dimensions and is lighter in weight than the first system, the open spraying of the cleaning liquid limits the intensity of the cleaning jets. Even if the liquid is sprayed with little energy, there is the problem of unwanted odor emission and the further problem of serious soiling contamination of the surroundings through rebounding liquid droplets.

In ultrasonic cleaning, which has frequently been proposed, sensitive parts are subjected to severe mechanical stressing which they are often incapable of withstanding. Thus, electronic components and type wheels of printers react to ultrasonic cleaning by developing hairline cracks so that they fail prematurely. The washing liquid required in large amounts soils quickly and involves both considerable supply costs and disposal problems.

An arrangement operated with a cleaning preparation which, for example, dissolves fats and resins, but does not affect plastics and rubber, is showing in DE-OS 38 02 486. The compact arrangement can be made transportable and does not require fixedly installed vent pipes. However, there is a need to simplify the cleaning process and to save labor. In addition, it has been found that, in a number of cases, mobile problem-free cleaning systems are limited in use by inadequate regeneration of the cleaning liquid collected, forcing the use of only fresh cleaning liquid, and causing reliability problems when working in closed rooms.

SUMMARY OF THE INVENTION

An object of the invention is to provide a cleaning system requiring less labor in cleaning small articles.

Another object of the invention is to provide a cleaning system with improved cleaning agent regeneration means for more efficient use of the cleaning agent, and for permitting free selection of the location of the cleaning system.

In the present invention, means are provided. after loading articles to be cleaned on a turntable located within an enclosed housing. Manual cleaning means are provided to clean critical places with a hand-operated spray gun during an automatic spraying process. Also, spraying is governed by a water pump selectively activated as required. Compressed air is used for operating hand-operated cleaning guns. A plurality of filtering means are provided for cleaning used cleaning fluid for reuse. Air exhausted from the cleaning system is prefiltered to remove therefrom any cleaning liquid vapor or small droplets, and other contaminants.

BRIEF DESCRIPTION OF THE DRAWINGS

The embodiments of the invention are described in detail below with reference to the accompanying drawings in which like items are identified by the same reference designation, of embodiments, wherein.

DETAILED DESCRIPTION OF THE INVENTION

Figure 1:
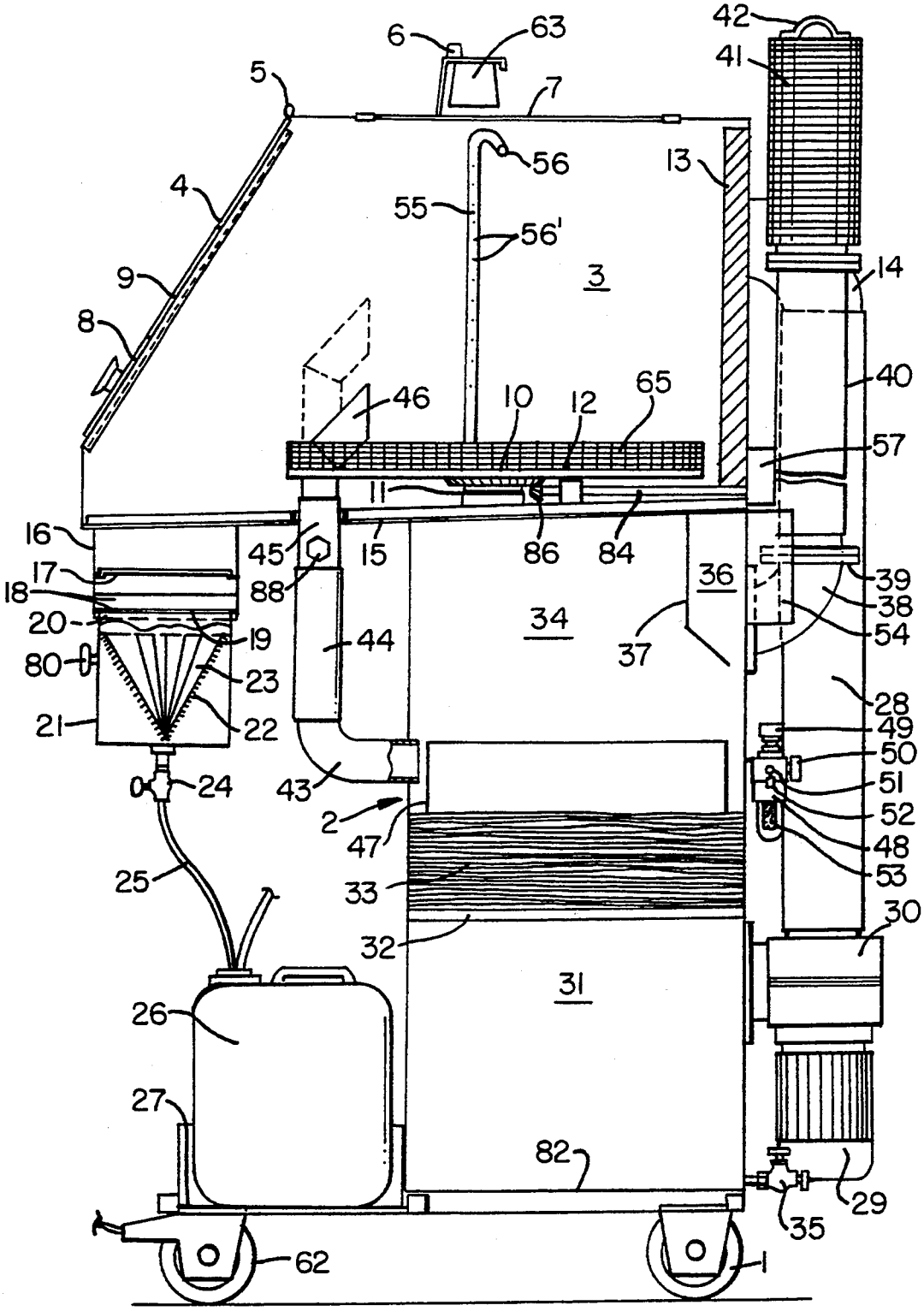
FIG. 1 is a longitudinal partial sectional view through a side elevational view of embodiments of the invention.

Provided on fixedly mounted or rotatable or pivotal and, preferably, lockable rollers 1 is a substructure 2 carrying a cleaning compartment 3 of which the loading opening is closed by a door 4 which is designed to be opened upwards by means of hinges 5, and to rest on rubber stoppers 6 when opened. To enable the cleaning operation to be better observed, the cover plate of the cleaning compartment is equipped with an inspection window 7, for example of acrylic glass. Similarly, the door 4 is closed by a front window 8 which has an opening 9 for introduction and operation of the cleaning guns.

Figure 2:
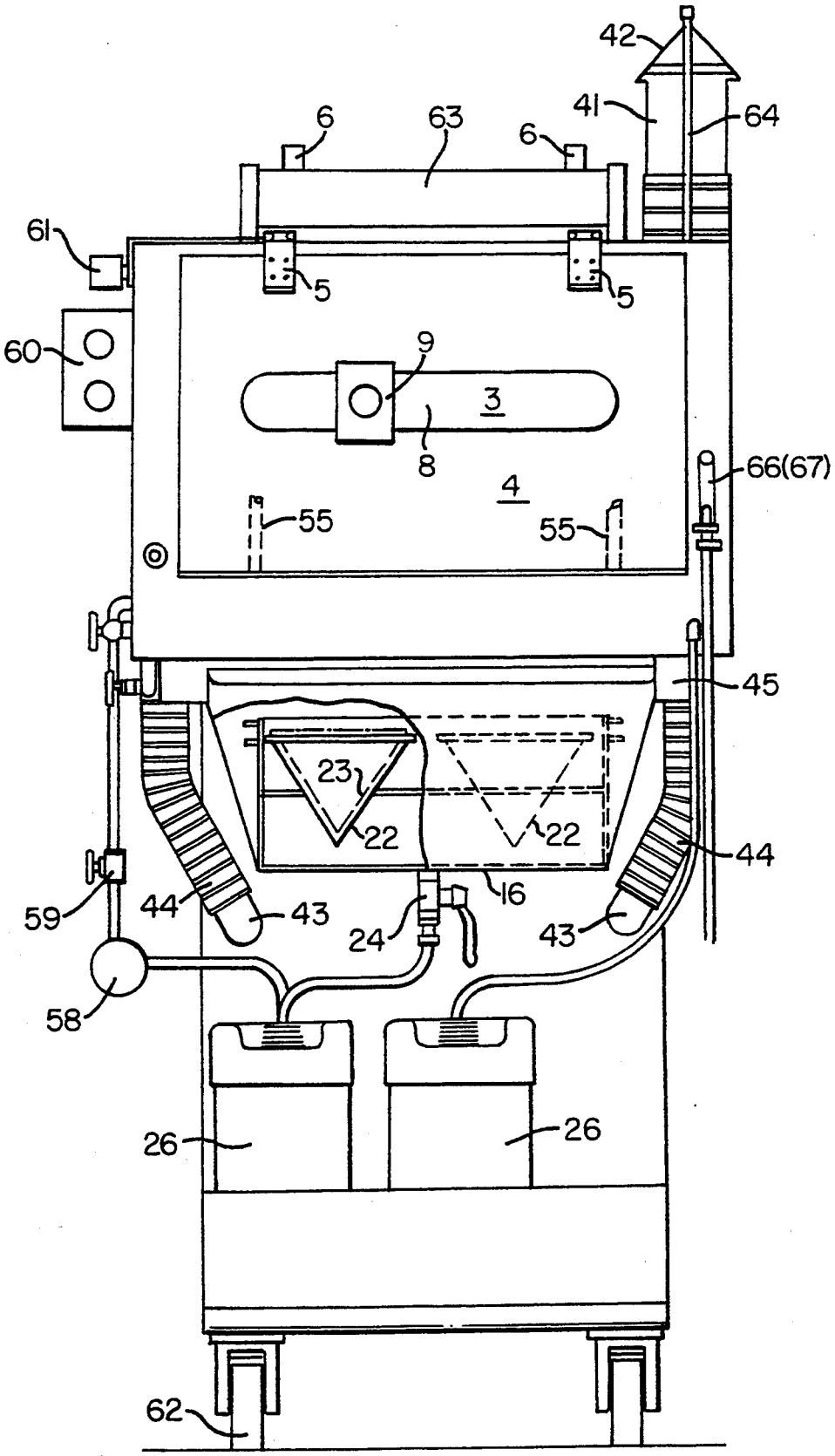
FIG. 2 is a partial cutaway view of a front elevational view of the embodiments of the invention.

A multiple-hole turntable 12 designed to be locked by a locking mechanism (not shown) is mounted on a pivot pin 10 in the cleaning compartment 3 to hold the articles to be cleaned. The pivot pin 10 is supported by an underlying thrust bearing 11. The locking mechanism is designed to brake the turntable or its hub by friction or to engage lockingly in the holes thereof. At its rear, the cleaning compartment 3 is closed by a removable baffle filter 13 consisting of at least two sets of slotted discs joined to one another. An elbow 14 is used to remove waste air from cleaning compartment 3, while liquid which has been sprayed therein and is dripping, for example, from walls thereof and the baffle filter 13, is able to run by way of the base 15, which slopes gently towards the door 4, into a filter housing 16. Located within filter housing 16 is a filter plate 17 in the form of another slotted disc, but which may also consist of a narrow-mesh net filter, for example with a mesh width of 1.20 mm. The base 18 of the filter housing slopes slightly upwards on one side and has two openings 19 at its center. Provided on the underneath of the filter housing 16 are linear guides 20 in which a filter unit 21 is extendably mounted by means of a knob 80 and which is preferably locked in the operating position illustrated by means of a detent mechanism (not shown). Beneath the openings 19, the filter unit 21 comprises two support cones 22 into which paper filters 23 are inserted. In the interests of inexpensive, problem-free supply, the paper filters 23 may be standard coffee filters which provide for excellent filtering or regeneration of the cleaning liquid and, in a double parallel arrangement, (See FIG. 2) are capable of filtering a substantially volume of accumulated liquid. Arranged in the base of the filter unit 21 is a normally-open outlet valve 24 through which the regenerated or filtered cleaning liquid is returned via the hose 25 to a container 26 arranged on the standing surface 27. A spray gun (not shown) used for cleaning may be operated from the same container.

In operation, waste air is removed from cleaning chamber 3 by a fan 30 operated by an electric motor 29, via the baffle filter 13, elbow 14 and the extraction hose 28 connected thereto, and is blown into the equalizing compartment 31 arranged in the lower part of the substructure 2, where it is able to stabilize. At the same time, large, medium and also fine droplets of the cleaning preparation are able to precipitate and to collect at the bottom of the equalizing compartment 31. A number of filter mats 33 knitted from metal wire which, through their close packing, form a narrow-mesh baffle filter are provided on a frame 32 which extends over the entire cross-section of the substructure 2. In this example, five 6 mm to 12 mm mesh filter nets 33 knitted from 0.3 mm to 0.6 mm thick metal wire are used. Above the filter mats 33 is a collecting chamber 34 receiving in which the volumes of air passing through the filter mats 33 equalizing compartment 31, over a large area at a relatively low flow rate are collected and are further cleaned through the precipitation of more droplets. The liquid residues precipitating here also drop down into the filter mats 33 and, together with the cleaning liquid collected by the filter mats, pass to the bottom 82 of the equalizing compartment 31 from which the liquid accumulating can be removed periodically, for example weekly or monthly, through an outlet valve 35. The liquid accumulating can also be periodically pumped. Therefrom into filter housing 16 by means of a small rotor pump, similar to that of a window washing unit of a motor vehicle, for example for filtering via filters 17 and 23, and delivery therefrom to container 26.

An outlet compartment 36 is formed in the collecting chamber 34 by means of a screening plate 37. The air which is further stabilized and purified by precipitation in the collecting chamber 34 is exhausted through the elbow 38, the exhaust hose 40 connected to the flange 39 thereof and an active carbon filter 41, under the effect of the excess pressure built up in the outlet compartment 36. Providing the exhaust hose 40 is of suitable length, for example 1 to 4 meters, and given a preferably slightly elevated suspension of the active carbon filter 41 by means of a bracket 42, the waste air is cleaned to an even greater extent before entering the active carbon filter 41, for increasing the efficiency and useful life thereof. By virtue of the gap formed on entry before the screen 37 and the throughflow resistance of the active carbon filter 41, air flow through the active carbon filter 41 remains minimal. Most of the air taken in by the fan 30 is returned to the cleaning compartment 3 through two elbows 43, two return hoses 44 and two guide sleeves 45. Preferably, at least after termination of cleaning, the returned air is directed by means of return nozzles 46 mounted for rotation and vertical adjustment on the ends of respective guide sleeves 45 onto the precleaned workpiece, for rapidly drying the workpiece.

The actual cleaning process takes place by means of compressed air and spray guns which are not shown in the drawing. The supply of compressed air both to the compressed air gun and to the spray gun can take place via a predetermined compressed air network, through cylinders or through a compressor which may even be set up at a distance from the arrangement. In the illustrated embodiment, the compressed air supply is connected via a fitting which is best provided on one side of the arrangement and not, as illustrated, on the back of the arrangement, preferably on that side which faces the maintenance flap 47. The maintenance flap 47 may be pivotally mounted although it may also be fixed by screws. In addition, it may be fixed to the frame 32 where the frame 32 is extendably mounted on a linear guide. In the illustrated embodiment, the compressed air fitting is in the form of a water separator 48, which is equipped with a pressure-reducing valve 49 and shut-off valve 50. In the preferred embodiments, the fitting is also connected to a manometer (not shown). The water separator 48 is provided with two connections or ports 51 and 52 to enable both a compressed air gun and a spray gun to be connected thereto. The separator housing 53 is best provided with a filter. Paper filters can be used, although cotton wool filters, for example, have proved suitable; they can be introduced, for example, in the form of a tampon and provide for the necessary cleaning of the compressed air.

The power cord for the electrical connection is preferably provided at its free end with a standard grounding-contact type plug, and can be connected to the terminal box 54. A manpower switch, unless provided on the side or the front of the subject cleaning device for better accessibility, can be included in terminal box 54.

In the preferred embodiment, riser tubes 55 are provided on both sides of the turntable 12 in the cleaning compartment 3, with the upper end of each tube 55 terminating in a spray nozzle 56, and being provided (preferably along a surface line) with further spray nozzles or openings 56' directed towards the turntable 12. These spray nozzles 56' can be inserted, pressed in or screwed into tubes 55, although they can also be in the form of directed bores. A drive assembly 57 consisting of an electrical motor, a connecting shaft 84 and a miter gear 86, slowly rotates the turntable 12; for exposing all surface zones of workpieces or articles placed the turntable 12 to the jets of cleaning medium emitted from the nozzles 56, 56'.

The spray guns used are operated by compressed air, whereas the riser tubes 55 are fed by a water pump 58 and a following valve 59, the suction connection of the water pump 58 being guided into one of the containers 26. The automatic operation can be switched on at the switch box 60, which comprises several control elements by means of which the spraying time, i.e. the actuation time of the water pump 58, and the forced air drying time, i.e. the actuation time of motor 29, can be adjusted. Also, controls can be provided for adjusting; the rotational speed of the drive assembly 57 of the turntable 12. Advantageously, a limit switch 61 is also provided and, for example via an angle lever (not shown) connected to a hinge 5, senses the opening of the door 4 of the cleaning compartment 3 and, after only a short opening stroke, at least suppresses spraying operations, and preferably also interrupts the circulation of air (turns off motor 29) to prevent air containing cleaning preparation from escaping from the opened cleaning compartment 3. It has also been found to be useful if one of the rollers 62 is in the form of a brake roller by which the arrangement can be brought to a definite halt. Cleaning work is facilitated by a lamp or light 63 which is arranged above the cleaning compartment 3, and which illuminates it through the inspection window 7. Arranged for extension and vertical adjustment in a tube connected to the rear of the cleaning compartment is a telescopic gallows 64, which enables the active carbon filter 41 to be adjusted to the particular height required. Cleaning work is further facilitated, and workpieces to be cleaned are prevented from unintentionally dropping off if the turntable 12 is provided with an encircling border 65. The accessibility and hence stability of the workpieces to be cleaned are further improved if the turntable 12 is formed by a wire basket.

In operation, the workpieces to be cleaned are placed on the multiple-hole or knitted-wire turntable 12 after the door 4 has been lifted open and laid against the rubber stoppers 6. In the case of printing plates for example, this may optionally be done by means of special holders adapted to the plates. After the workpieces have been placed in position on turntable 12, the door 4 is returned to the illustrated working position, and a compressed air gun 67 is first introduced through the opening 9 of relatively narrow cross-section to blow away any loose dirt and soil from the workpieces to be cleaned. The water pump 58 is then switched on to subject the workpieces to initial cleaning. Next, water pump 58 is turned off to permit soaking of the workpieces in the cleaning fluid coating. After a certain time, the necessary soaking is achieved and the workpieces are then resprayed with the cleaning liquid by turning on pump 58, so that partly dissolved soil constituents, such as partly resinified oils for example, can be sprayed off. At the same time, the turntable 12 is continuously rotated by switching on the drive assembly 57 so that the jets of the spray nozzles 56, 56' wet the workpieces from all sides.

A final overspray ensures the desired cleanness. The workpieces can now be surface-dried by reusing the compressed air gun 67 to blow away any still adhering parts and droplets of cleaning liquid. Even longer residence in the cleaning compartment with the fan motor 29 switched on ensures complete drying although, even in the case of electronic devices, complete drying is not absolutely essential on account of the low conductance of the cleaning liquid used.

It has been found to be essential for air, optionally mixed with droplets of the cleaning liquid, to be continuously removed from the cleaning compartment 3 while the fan 30 is in operation. However, a considerable percentage of this air, for example 92%, is recycled through the elbows 43, the return hoses 44 and the return nozzles 46 so that the returning air sweeps over the workpieces and additionally removes soil and residues of cleaning liquid, but at least has a drying effect. By rotation and vertical adjustment, the nozzles 46 can be directed onto the workpieces and fixed by means of the screws 88 of the guide sleeves 45.

While the compressed air gun 67 and the spray gun are in operation, they additionally blow air into the cleaning compartment 3, the opening 9 being designed in such a way that although substantially uninterrupted operation of the compressed air gun 67 and the spray gun is possible, not too much outside air enters the cleaning compartment 3. At the same time, the slight reduced pressure established in the cleaning compartment 3 is used to stop any droplets or fumes of the cleaning preparation from escaping to the outside. A gentle air stream flows continuously into the cleaning compartment 3 through the opening 9, forcing the air already present therein back towards the baffle filter 13 and the elbow 14.

This inflowing air has to be removed again during the formation of the air circuit. The amount of air removed is determined by the pressure in the collecting chamber 34 in conjunction with the resistance provided by the active carbon filter 41. This air, which is to be taken outside, is initially covered by the screening plate 37 against the actual collecting chamber 34 so that further removal can occur in the outlet chamber 36 and in the waste-air hose 40 connected to the elbow 38. The air to be removed from the circuit undergoes final cleaning in the active carbon filter 41. In many cases, however, adequate cleaning of the waste air is actually achieved where the active carbon filter 41 is directly connected to the elbow 38.

The present invention provides both regeneration or filtering and removal of air, whereby the air issuing from the present device into the room where the device is set up is thus cleaned to such an extent that it is not harmful to health and cannot be noticed at all, for example through the sense of smell. By virtue of the high filtering or regeneration level, it is no longer necessary (as in prior devices) to use two different liquids, namely new liquid, and for initial cleaning and for soaking already used, but regenerated liquid. The number of containers required can thus be reduced to one so that the mobility of the cleaning device is also increased relative to the prior devices. The high filtering or regeneration level also ensures an extremely long useful life of the cleaning liquid introduced into the circuit so that it remains useable for a very long time and, hence, also does not present any disposal problems. In cases where, in particular, the halogen-free cleaning liquid (containing neither chlorinated nor fluorinated hydrocarbons) intended for this present device is used, disposal problems are reduced to a minimum both through its composition and through the minimum quantities of liquid discharged.

Various workpieces can thus be successively cleaned and freed effectively and substantially completely from dirt, oil residues and the like in the present mobile arrangement, which is also easy to transport by virtue of its considerably reduced weight. Another advantage of cleaning with the the present device is that it does not involve significant mechanical stressing of articles being cleaned. Thus, entire typewriters, telex machines or parts thereof, printers and both mechanical and purely electronic parts of electronic arrangements can be cleaned without difficulty.

Although various embodiments of the invention have been shown and described herein, they are not meant to be limiting. Those of skill in the art may recognize certain modifications to these embodiments, which modifications are meant to be covered by the spirit and scope of the appended claims.

What is claimed is:

1. A system for cleaning mechanical and/or electrical equipment or devices with cleaning liquids, comprising:

an enclosed uppermost cleaning compartment having a closeable front loading opening, back, top, bottom, and right and left sides;

at least one riser pipe vertically mounted within said cleaning compartment, said riser pipe including a bottom end for receiving cleaning liquid, a top end, an elongated main stem between said top and bottom ends, and a plurality of spaced holes through said main stem between the top and bottom ends thereof;

a first spray nozzle attached to the top end of said riser pipe;

a plurality of second nozzles inserted in said holes along said main stem, respectively;

a turntable mounted in said cleaning compartment, juxtaposed to said one riser pipe, said turntable being for carrying workpieces to be cleaned;

drive means connected to said turntable, for rotating said turntable at a selected speed;

a source of cleaning fluid;

pump means connected between said source of cleaning fluid and the bottom end of said riser pipe, for pumping cleaning fluid to said riser pipe, for spraying out of said first and second nozzles, for wetting workpieces rotating on said turntable;

recirculating means for collecting, filtering, and returning filtered cleaning fluid from said cleaning chamber to said source of cleaning fluid;

an enclosed collecting chamber located immediately below said cleaning chamber;

an enclosed equalizing compartment located below said collecting chamber;

a frame including five 6 to 12 mm mesh filter mats knitted from 0.3 to 0.6 mm thick metal wire located between said collecting chamber and said equalizing compartment, said filter mats being arranged to lie successively on top of one another;

an extraction hose connected from said cleaning compartment into said equalizing compartment;

fan means connected in an air path provided by said extraction hose, for drawing waste air from said cleaning compartment, through said extraction hose, and into said equalizing compartment, whereby the air is forced via pressure from said fan means, to flow through said five mesh filter mats for filtering, and into said collecting chamber under pressure; and aeration pipe means connected from said collecting chamber into said cleaning compartment, for supplying air under pressure from said collecting chamber into said cleaning compartment for drying workpieces cleaned therein.

2. The cleaning system as claimed in claim 1, wherein the turntable is provided with an encircling border.

3. The cleaning system as claimed in claim 2, wherein the turntable is in the form of a wire basket.

4. The cleaning system as claimed in claim 2, further including a switch box including control elements for controlling the energization time of the pump means, the operating time of the fan means, and the operating time and rotational speed of said drive means driving said turntable.

5. The cleaning system as claimed in claim 1, wherein the turntable is in the form of a wire basket.

6. The cleaning system as claimed in claim 5, further including a switch box including control elements for controlling the energization time of the pump means, the operating time of the fan means, and the operating time and rotational speed of said drive means driving said turntable.

7. The cleaning system as claimed in claim 1, further including control elements for controlling the energization time of the pump means, the operating time of the fan, and the operating time and rotational speed of said drive means driving said turntable.

8. The cleaning system of claim 1, wherein said drive means includes:

a thrust bearing mounted between a center bottom portion of said turntable, and the bottom of said cleaning compartment;

a motor driven connecting shaft; and a miter gear driven by said connecting shaft for rotating said turntable.

9. The cleaning system of claim 1, further including:

another riser pipe substantially identical to said first riser pipe, said another riser pipe being mounted on an opposite side of said turntable from said one riser pipe;

another said first spray nozzle attached to the top end of said another riser pipe; and another plurality of said second nozzles inserted in holes along a main stem of said another riser pipe, respectively;

said pump means further being connected between said source of cleaning fluid, and a bottom end of said riser pipe, for pumping cleaning fluid thereto.

10. The cleaning system of claim 1, further including:

a vent pipe having one end connected into said collecting chamber, and another open end; and an active carbon filter connected to said another end of said vent pipe, for filtering air removed from said collecting chamber via said vent pipe before the air is passed into the atmosphere.

11. The cleaning system of claim 1, further including:

a removable baffle filter installed through a side wall of said cleaning chamber, for permitting ventilating air to be drawn into said cleaning chamber.

* * * * *